United States Patent [19]

Ecker

[11] Patent Number: 4,607,470

[45] Date of Patent: Aug. 26, 1986

[54] PRE-STRESSED CONSTRUCTION ELEMENT

[75] Inventor: Fred L. Ecker, Sierra Madre, Calif.

[73] Assignee: Concrete Systems, Inc., Azusa, Calif.

[21] Appl. No.: 695,393

[22] Filed: Jan. 28, 1985

[51] Int. Cl.[4] ..... E04C 3/10

[52] U.S. Cl. ..... 52/226; 52/729

[58] Field of Search ..... 52/225, 226, 729, 223 R

[56] References Cited

U.S. PATENT DOCUMENTS

| | | | |
|---|---|---|---|
| 2,822,068 | 2/1958 | Hendrix | 52/226 |
| 3,010,257 | 11/1961 | Naillon | 52/225 |
| 3,427,773 | 2/1969 | Kandall | 52/225 |

*Primary Examiner*—James L. Ridgill, Jr.

*Attorney, Agent, or Firm*—Christie, Parker & Hale

[57] ABSTRACT

A pre-stressed construction element is set forth which includes a rigid member adapted to span longitudinally between upright supports and to define a load bearing construction element. At least one tendon extends longitudinally along the member and is connected at or adjacent the ends of the member. To pre-stress the member, each tendon is tensioned resulting in a pre-stressing compressive force to be imposed on the member at its ends. Pre-stressing enhances the load bearing characteristics of the member. To impose lateral pre-stress forces on the member supports may be provided. One or several tendons engage are deflected by and underlie the support. When the tendon is tensioned, a force is imposed upon the support and thereby the member.

4 Claims, 12 Drawing Figures

PRE-STRESSED CONSTRUCTION ELEMENT

FIELD OF THE INVENTION

This invention relates to construction elements such as beams or the like. More particularly, this invention relates to pre-stressed construction elements of steel and concrete.

BACKGROUND OF THE INVENTION

In construction of buildings or the like, beams are used to span between upstanding members which may be columns. The beams are adapted to carry loads such as a concrete floor. It has been known to use both steel and concrete as beams. Steel is often used because of its enhanced to load bearing characteristics per unit weight over concrete beams. Accordingly, steel beams, i.e. I-beams, are erected to span between columns and carry the designed loads. It has also been known to use external tensioning of the steel beams. External tensioning is accomplished by suitable location of the columns and by tensioning the beam to span therebetween.

In addition to steel beams it has been known to use concrete beams which may be internally post or pre-stressed. To construct the concrete beams, a network of steel cables extends through and along the length of the beam. If the beam is to be pre-stressed, the cables are positioned in a mold, the mold having steel plates at its ends. Hydraulic jacks or the like are used to tension the cables in the mold. Thereafter concrete is poured into the mold between the end plates to encase the cable network. After the concrete has sufficiently hardened, the tension cables are secured to the end plates and released to place the concrete beam in compression. In post-stressing, the network of cables is positioned and concrete is poured thereabout either in a mold or in situ to encase the cables. End plates are attached to the concrete beam, certain cables extending therethrough. After the concrete is sufficiently hardened, the cables are tensioned and thereafter secured to the end plates and released to place the concrete beam in compression. The aforementioned pre-stressing and post-stressing techniques are effective to enhance the load bearing characteristics of the beam.

Heretofore, however, it is believed that it has been unknown to apply post-stressing techniques to enhance the load bearing characteristics of other types of beams such as steel, aluminum or others.

The beams in some if not most cases provide support for a floor in the structure. This floor may be concrete. To form the floor, it has been known to pre-cast a concrete beam according to the method described above, the beam including a portion of the floor. When the beams are set in place between the columns, the floor portions mate to define an overall concrete floor for the structure. This technique is common for parking garages or the like. However, a problem with this technique is that the seams between the four sections and between the beams and columns tend to leak, causing unslighty watermarks and other related problems. Further the structure may not be able to withstand a seismic event of any significant intensity.

Further it is believed that this construction technique of pre-casting or assembling the beam and floor portions is time consuming and costly.

Another method to form a concrete floor is to erect forms to receive liquid concrete for forming, in situ, the floor and some or perhaps all of the concrete beams. To hold the concrete until it hardens, these forms are supported by a network of shoring assembled beneath and bearing the loads of the forms and liquid concrete. These forms are constructed and supported so as to encase any structural steel or the like within the concrete. As can be appreciated, the network of shoring and the construction of the forms is time consuming and costly. The present invention is directed toward to overcoming the problems noted above.

SUMMARY OF THE INVENTION

The present invention is directed toward a pre-stressed construction element which includes a rigid member adapted to span longitudinally between upright supports and to define a load bearing construction element. The rigid member may be a metal beam or perhaps a beam fashioned from other, non-cementatious materials such as certain construction plastics or the like. To pre-stress the member, at least one tendon extends longitudinally along the member and is connected at or adjacent the ends of the member. To pre-stress the member, each tendon is tensioned resulting in pre-stressing force, i.e., compression to be imposed on the member at its ends. The aforementioned pre-stressing enhances the load bearing characteristics of the member. Either subsequent or before the tensioning of each tendon the member is affixed between the supports by suitable means.

To impose lateral pre-stress forces on the member such as, for example, vertical forces at locations along the member, supports may be provided. In a specific example, a support may be disposed medially on the member. One or several tendons engage are deflected by and underlie the support. When the tendon is tensioned, a force is imposed upon the support and thereby the member. These upward forces tend to counteract the downward deflection of the member when it is loaded and may be calculated to offset certain live loads or the like.

The aforesaid pre-stressing of the member enhances its load bearing characteristics. Accordingly, for given loads smaller, less expensive members may be used. An advantage over concrete beam members is that the pre-stressed members according to the present invention tend to result in lighter beams, an overall lighter and more ductile structure. When the floor or any other load is imposed upon the member, pre-stressing enables the load bearing members to resist deflection and support the load.

Where the structure is to include concrete floors, pre-stressed members may be suitably positioned as determined by the building layout and structure requirements. Thereafter forms may be attached to or supported by the members, the forms adapted to receive and retain liquid concrete. If desired, the forms may be positioned such that the concrete encases the members providing fire protection therefor and an aesthetically pleasing appearance. Accordingly, unlike prior art techniques, form supporting scaffolding is not required. The erection and disassemble of scaffolding is expensive, time-consuming and restricts or prevents access to the areas beneath the forms.

BRIEF DESCRIPTION OF THE DRAWINGS

These and other features and advantages will become apparent as the same become better understood with reference to the specification, drawings and claims wherein:

DETAILED DESCRIPTION

Figure 1:
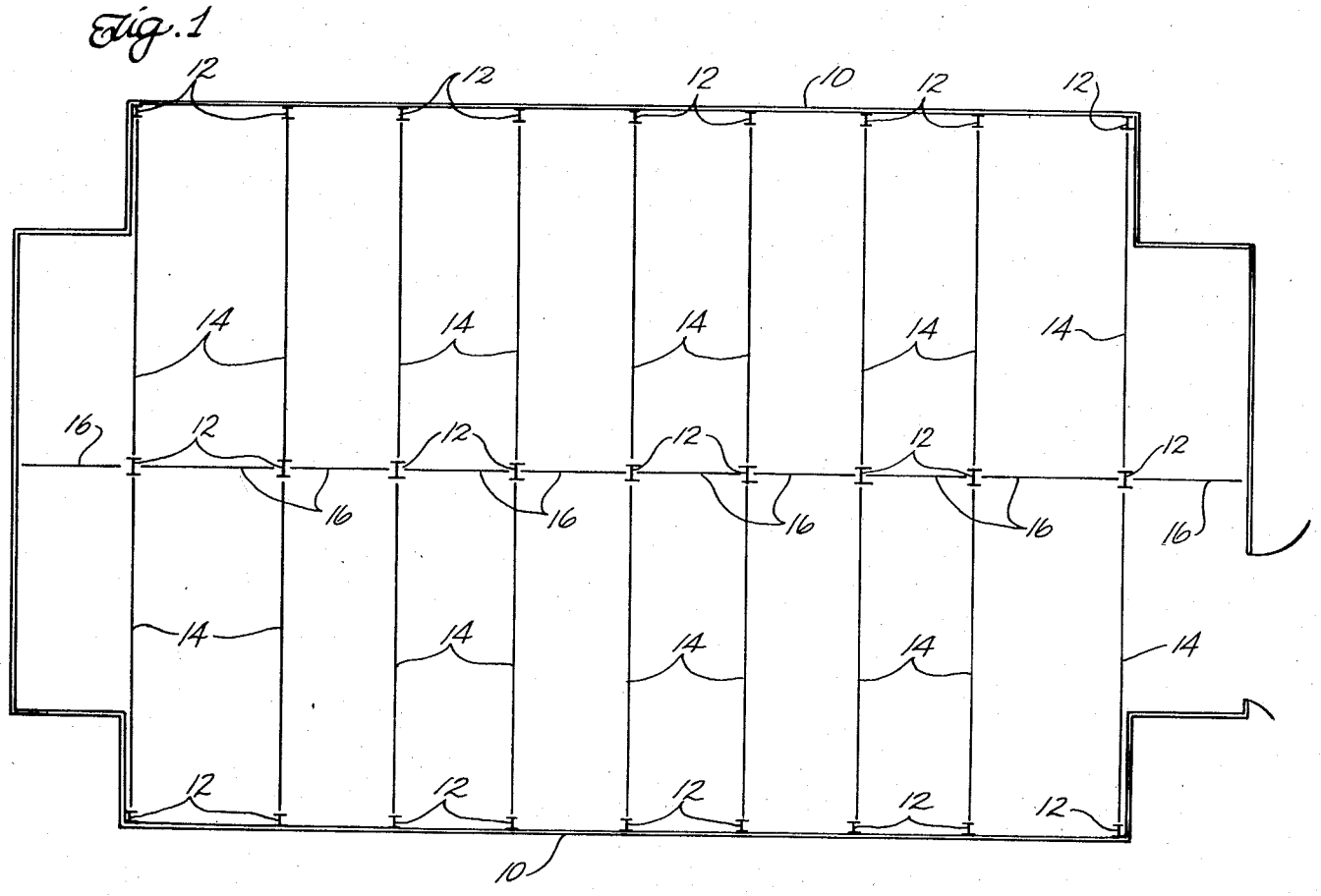
FIG. 1 is a schematic plan view of a structure illustrating the positioning of the construction elements according to the present invention.

Turning to the drawings, FIG. 1 illustrates a floor plan for a structure which may be an office building, parking garage or the like. The structure as illustrated shows an outside wall or footing 10 and upstanding columns 12 positioned as determined by the projected loads and layout of the structure. The columns 12 may be steel I-beams, precast or cast in place concrete columns. While this description is directed toward a parking structure, it is to be understood that its teachings can also be directed to any other suitable structures. To transfer loads to the columns 12, which may be a concrete floor, elements shown as beams 14 according to the present invention are positioned to span between certain pairs of columns 12. Ties 16 may also be fashioned to span between certain pairs of beams 12 as shown in FIG. 1.

Heretofore, the beams for structures such as parking garages have been essentially of two types. One type has been simple steel I-beams sized to withstand and transfer loads to the columns without significant deflection. Accordingly, these beams are sized to take into account the static load of a floor or the like and line loads such as automobiles. Another type of element has been concrete beams which may also be fashioned to include portions of the floor. The beams including the floor portions are typically pre-cast, brought to the job site and set in place on the columns. It has also been known to cast concrete to form, in situ, the beams and floor.

These prior construction elements have proven unsatisfactory in that leaks develop in the floor and, for in situ cast beams, scaffolding is required to hold concrete forms for the concrete.

Turning to FIGS. 2A–D, various embodiments of the pre-stressed construction element shown, as beam 14, are illustrated according to the present invention. The beam 14 has a longitudinal dimension which spans between a pair of upstanding columns 12. To provide for connection of a beam 14 therebetween each column 12 may be provided with connection plates 18 projecting therefrom.

Figure 3:
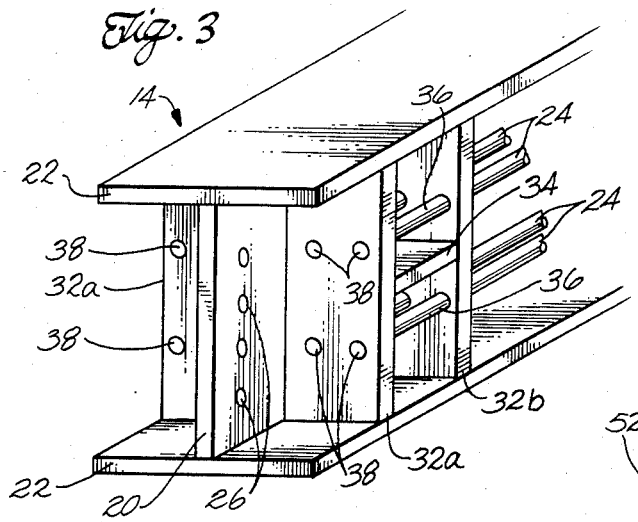
FIG. 3 is a perspective view of an end of the element according to the present invention.

The beam 14 may be of any suitable shape; however, as is most common, the beam 14 is most likely embodied as an I-beam as shown in FIG. 3. The I-beam may be constructed of steel, aluminum or other suitable construction materials, the beam 14 having a web 20 interconnected between two spaced flanges 22 to give the beam 14 an I-shaped cross section. As most often used in construction, the beam 14 has its components, i.e., the web 20 and flanges 22 sized and arranged to support the projected loads. For larger loads, accordingly, the beam 14 must be of heavier construction.

Figure 2A:
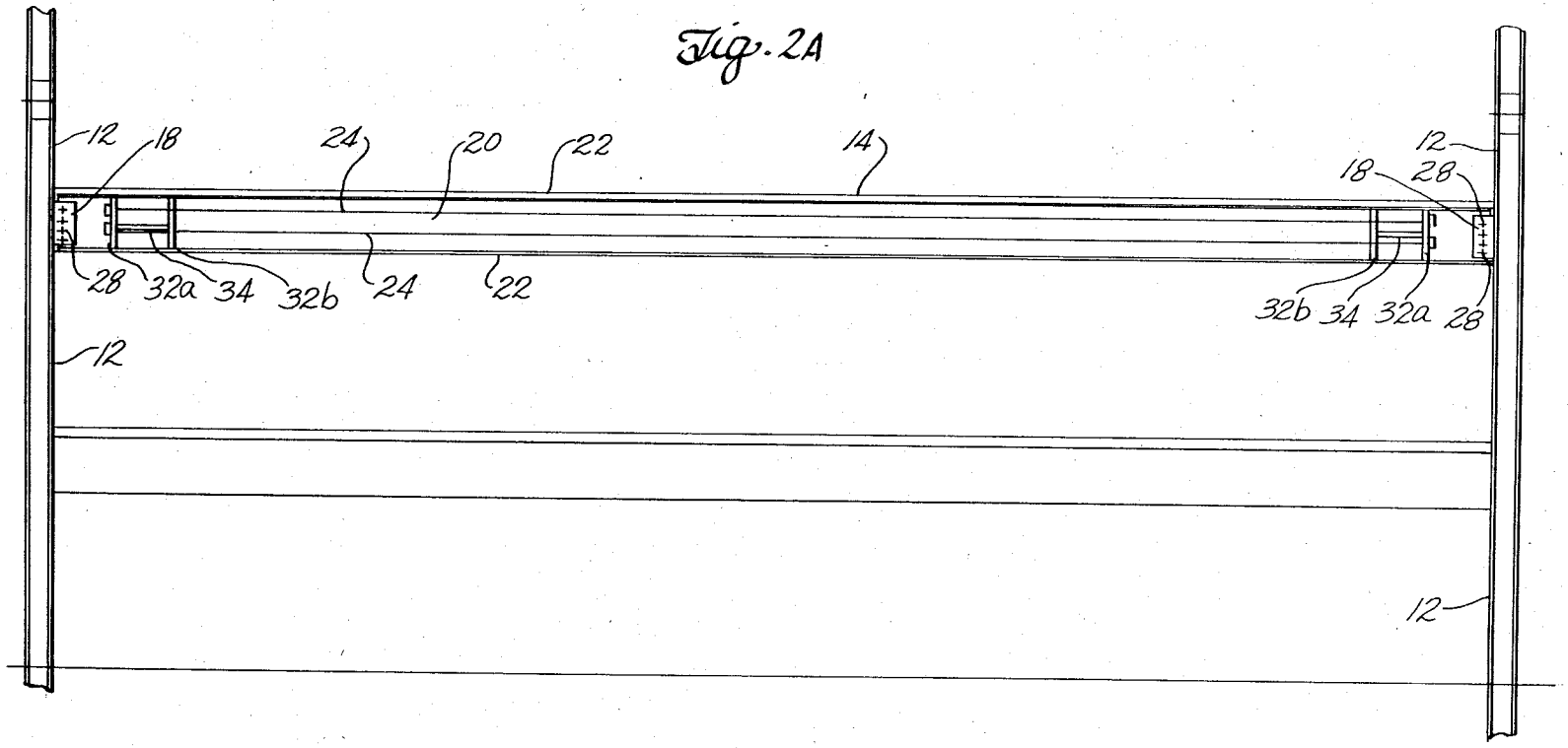
FIG. 2A is an elevation view showing one embodiment of a pre-stressed construction element according to the present invention connected between upstanding supports.

To enhance the strength of the beam 14 so that relatively smaller and lighter beams may be used to support a given projected load, the present invention includes at least one tendon 24 extending longitudinally alongside the beam 14, the tendon 24 being connected to the beam proximate each end thereof. As shown in FIG. 2A, one embodiment of the invention includes eight tendons 24, four disposed on each side of the web 20. These tendons 24 are adapted to be tensioned thereby pre-stressing the beam 14 by placing the beam under compressive forces. While the tendons 24 may be of any suitable construction such as steel rods or the like, preferably the tendons 24 are embodied as steel cables having a number of strands. Each cable is connected to the beam 14 after or during the tensioning thereof in much the same manner as our tensioning cables for pre- and post-stressed concrete structures.

Figure 5B:
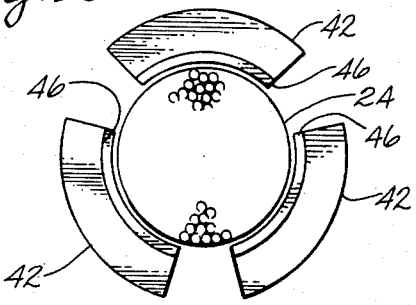
FIG. 5B is an end view of the tendon attaching means of FIG. 5A.
Figure 5A:
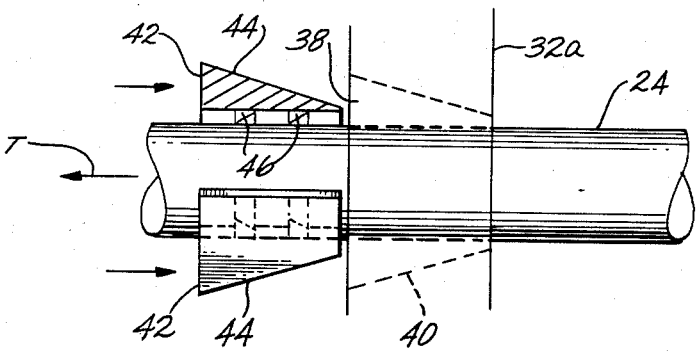
FIG. 5A is a side view of a portion of the end of the element according to the present invention showing the tendon attachment means.

Turning to FIGS. 3, 5A and 5B, the beam 14 and the preferred method for attaching the tendons 24 to the beam ends is shown. The beam 14 at each end is provided with means for connecting the beam 14 to the upstanding columns 12. As shown in FIG. 3, this method may include a series of spaced holes 26 which when the beam is positioned register with bores 28 of the connecting plates 18. By passing suitable fasteners such as bolts through the holes 26 and bores 28, each beam 14 may be connected between a column pair.

Spaced inwardly from the holes 26, between the beam flanges 22, a box 30 is provided at each side of the beam 14. It is to be understood that while the box 30 may be as describe herein, that any suitable structure may be used as a support for connecting the tendons to the beam 14. The box 30 has, as viewed in elevation, an H-shape defined by spaced vertical plates 32*a* and 32*b* and a medially positioned, interconnecting horizontally disposed rib 34. Each of the plates 32*a* and 32*b* is welded to the web 20 and flanges 22 and the rib 34 is welded to the web 20 and to the plates 32*a* and 32*b*. By virtue of the plates 32 and rib 34, the box 30 is strong and provides a rigid connection for the tendons 24 to the beam 14. Plate 32*a* is located nearer the holes 26 and end of the beam than is plate 32*b*.

To accommodate each tendon, plate 32*b* includes a bore 36. The tendon passes through and is guided by the bore 36. As seen in FIG. 3, the various bores 36 are arranged in the plate 32*b* to either side of the rib 34. These bores may be arranged offset with respect to the longitudinal axis for the beam 14 for purposes which are set forth below. Cooperating with each bore 36 plate 32*a* includes a conical aperture 38 adapted to receive the tendon 24 in the manner described below.

As shown in FIG. 5A, the aperture 38 has a minor diameter to closely receive the tendon 24, the aperture expanding to a major diameter. A conical wall 40 defines the bounds for the aperture 38.

With reference to FIGS. 5A and 5B, the tensioning of each tendon will now be described. Each tendon 24 extends between the boxes 30 located proximate each of the beam 14. At the box at one end of the beam, the tendon 24 may be secured by a suitable connector or the like. This connector may be embodied as a large head adapted to abut the plate 32*a* about the aperture 40. Alternatively, each tendon 24 may be received and grasped by a hydraulic jack of the type used to tension cables for pre- or post-stressed concrete members. In a manner which is known in the art, these hydraulic jacks connect to the tendon 24 and are supported by the plate 32*a*. Actuating the hydraulic jack pulls the tendon 24 at each end relative to the box 30 until a predetermined tension of, for example, 700 pounds in the tendon 24 is achieved.

When each tendon 4 has been suitably tensioned, wedges 42 are driven into the aperture 38 to fasten the tendon to the plate 32*a*. As illustrated, each wedge may be embodied as a conical section having an outside surface 44 adapted to engage the wall 40 of the aperture 38, each wedge 42 being provided with one or a plurality of rows of teeth 46 which are adapted to engage and by into the tendon, the wedges 42 being retained in the aperture 38. In this fashion, the tendons 24 may be tensioned and thereafter secured to the beam 14 proximate the ends thereof by the cooperation between plates 32*a* and more particularly the apertures 38 and the wedges 42.

The aforesaid tensioning of the tendons 24 and the connection to the beam 14 proximate the ends thereof results in the beam 14 being subject to end directed compressive forces. When an unstressed beam is loaded with, for example, a concrete floor, the beam is deflected which tensions the beam. By pre-stressing the beam with compressive forces, the tension resulting from loading of the beam can be counteracted thereby enabling a smaller and lighter beam to accommodate larger loads. By offsetting the bore arrangement with respect to the longitudinal axis for the beam 14 a moment is imposed on the beam 14. This moment tensions the upper flange 22 and places the lower flange 22 in compression.

Figure 2B:
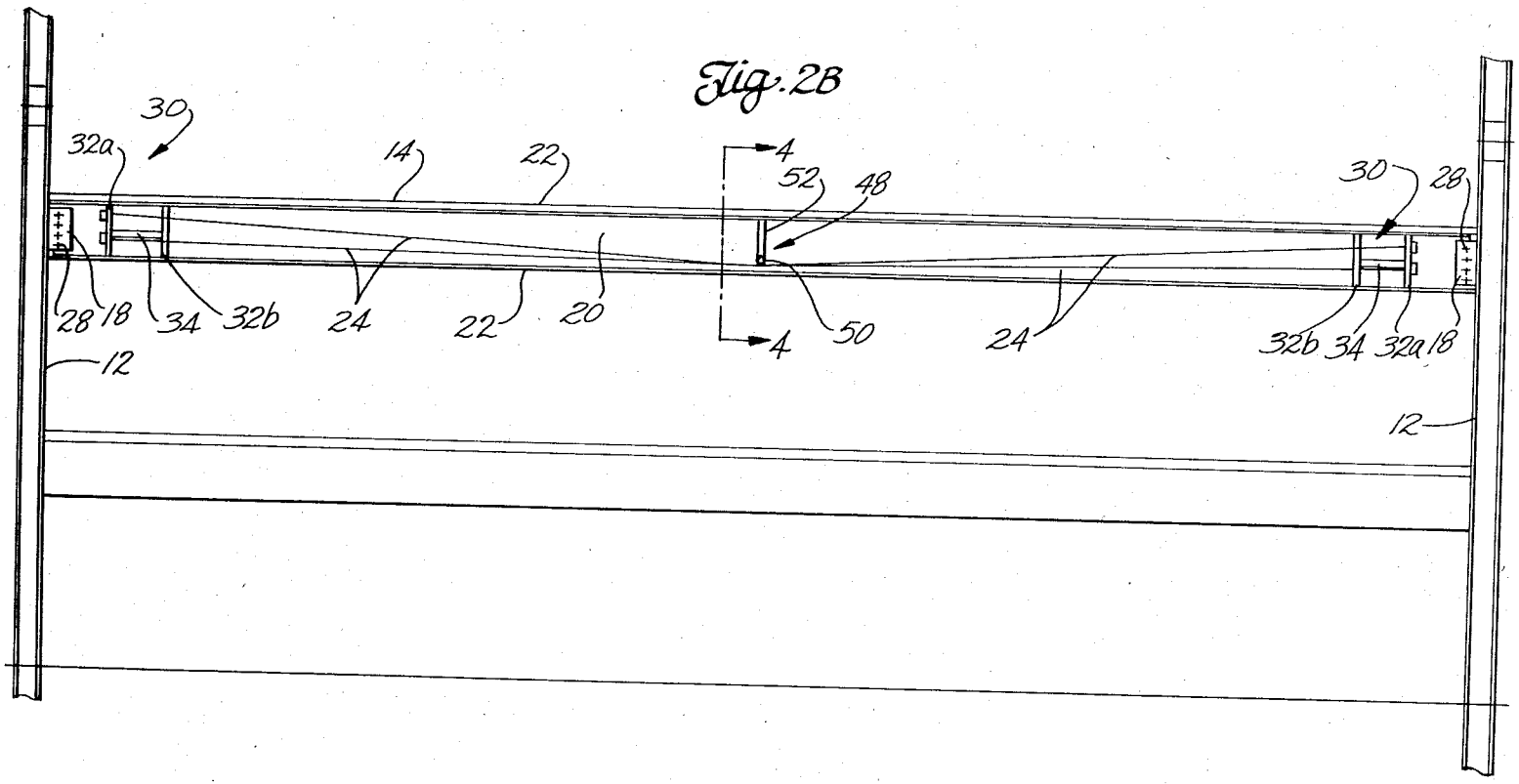
FIG. 2B is an elevation view of an element according to another embodiment of the present invention shown spanning between two upright supports.
Figure 4:
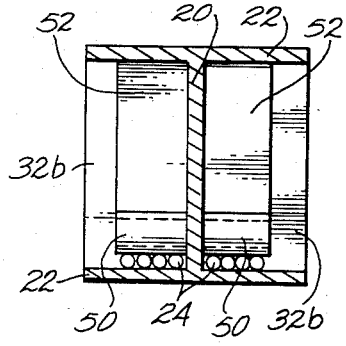
FIG. 4 is section view of the member according to the present invention taken along line 4—4 of FIG. 2B.

Turning to FIG. 2B another embodiment of the element according to the present invention is shown. Like elements carry like reference numerals. The beam 14 shown in FIG. 2B includes means for imposing upwardly directed forces upon the beam 14 to counteract loads imposed thereon and to enhance the pre-stressing which may be occasioned by the offset of the bores and tendons. Accordingly, beam 14 includes a tendon support 48 disposed medially of the beam 14. As shown in FIG. 4, the support 48 may be embodied as a tube 50 affixed to the web, preferably proximate the bottom flange. To add additional support to the tube 50, a strut 52 may be interconnected between the tube 50, beam web 20 and the top flange 22. With reference to FIGS. 4 and 2B, it is seen that the tendons 24 extend between the boxes 30 and beneath the tube 50. The tube 50 is located so that the tendons at the tube 50 are laterally offset with respect to common longitudinal axes of the bores of the boxes 32.

As can be appreciated, when the tendons 24, the beam 14 in FIG. 2B are tensioned, the beam 14 is subject to compression forces imposed at its ends, i.e., the boxes 30, whereas the support 48 is subject to a force which is the vertical component of the force resulting from the tensioning of the tendons 24. By so providing the support 48 a vertical force component is provided medially at the beam 14 to counteract either a portion of the static loading on the beam 14 or perhaps certain projected live loads.

Further, the location of the support 48 serves to control deflection of the beam which may be occasioned by the tensioning of the tendons 24. For example, in the embodiment shown in FIG. 2B, the upwardly directed forces are concentrated at the support 48 thereby also tending to concentrate the deflection medially on the beam 14. By appropriately tensioning the tendons 24 the vertical force and deflection may be selected not only to counteract the loads as described above but also to oppose the deflection imposed by loading of the beam. For example, when the beam of FIG. 2B is loaded, and some amount of vertical deflection is occasioned, when the beam 14 is loaded the weight of such loads deflects the beam 14 to the horizontal or, if desired, to a slightly sagged condition. As can be appreciated, when the beam 14 is loaded such loads are resisted by further tensioning of the tendons which increases the pre-stressing of the beam 14 and the vertical force at the support 48.

Figure 2C:
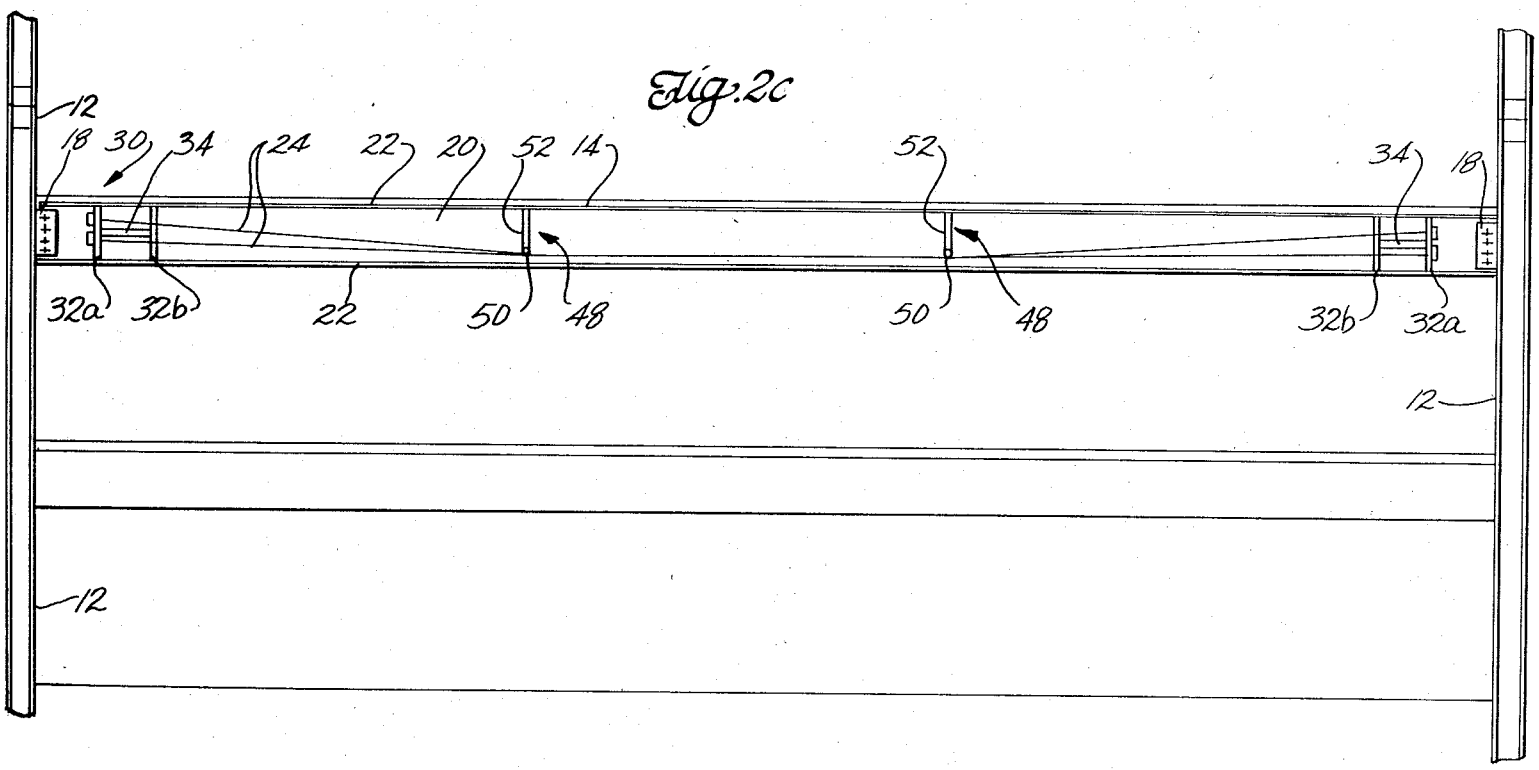
FIG. 2C is an elevation view of yet another embodiment of the element according to the present invention shown spanning between two upright supports.

Turning to FIG. 2C, yet another embodiment of the beam 14 is shown. In this embodiment, a pair of supports 48 are located at one-third positions along the beam 14. Each of the supports 48 are of the type described above. As shown in the drawing the tendons 24 extend between the boxes 30 and beneath the supports 48. When the tendons 24 are tensioned, such tensioning imposes vertical resultant forces upon the supports 48 and the beam 14. Again, by this embodiment, deflection of the beam 14 may be controlled and the vertical resultant forces tend to counteract loads and resist deflection. Again, when the beam 14 of FIG. 2C is loaded with for example a concrete floor, such loads will cause the beam 14 to deflect to perhaps a sagged position further increasing the tension on the tendons. The increased tension tends to resist the sagging with ever increasing force.

Figure 2D:
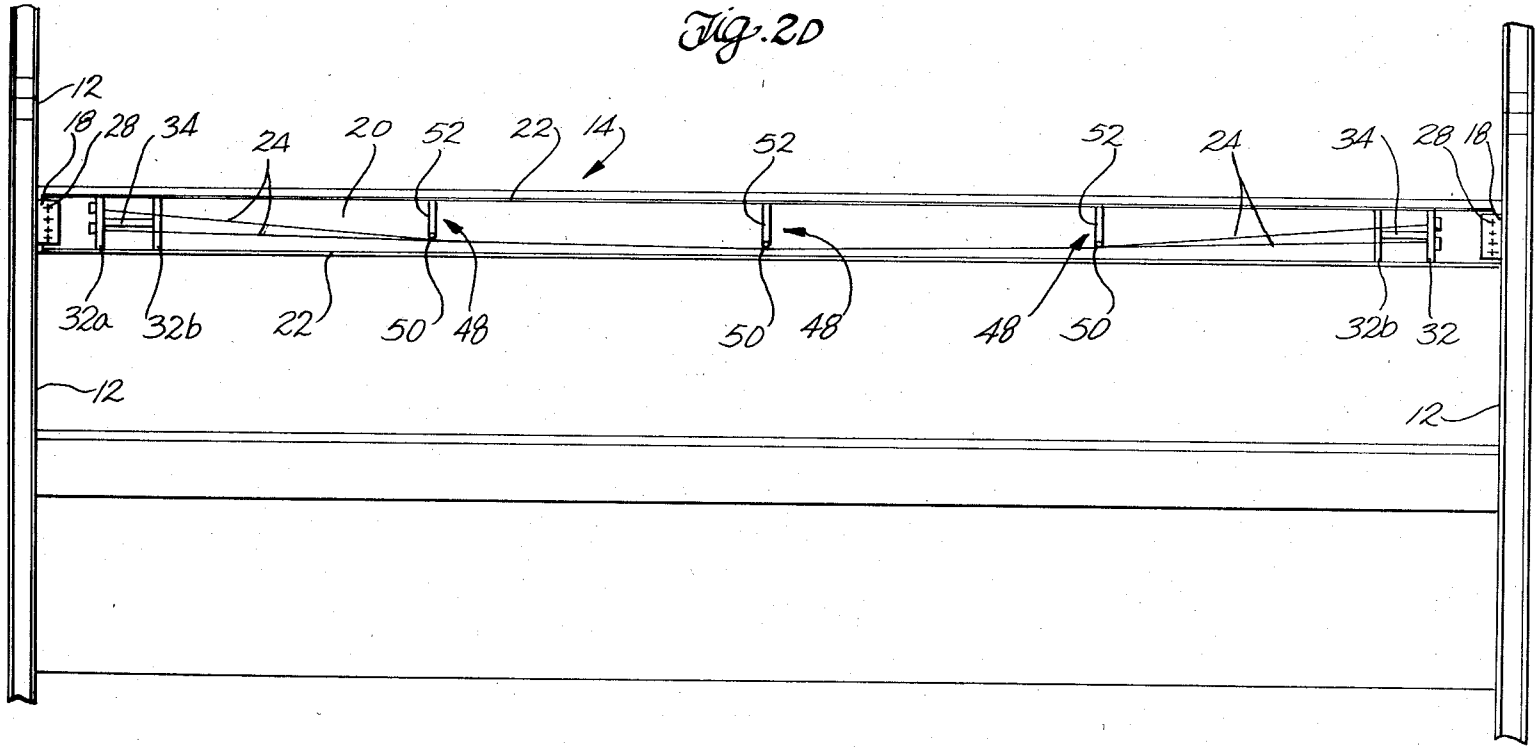
FIG. 2D is an elevation view of still another embodiment of the element according to the present invention shown spanning between upright supports.

Turning to FIG. 2D, still another embodiment of the beam 14 according to the present invention, is shown. In this embodiment, three such supports 48 are spaced at one-quarter length intervals along the beam between the boxes 30. The tendons 24 pass beneath the supports 48, the tendons when tensioned imposing a vertical resultant force upon the supports 48 and the beam 14. Again, according to this embodiment, in a manner similar to those described above, the vertical resultant forces tend to counteract loading and tend to produce an upward deflection in the beam 14. When the beam is loaded the load tends to return the beam to the horizontal or perhaps a sagged position further tensioning the tendons which act to increase the compression induced upon the beam and to resist the loading.

The aforesaid embodiments of the invention for the beam 14 act to enhance the load bearing characteristics of the beam. Accordingly, smaller and lighter beams may be used for given loadings. Further by controlling deflection, sagging can be eliminated or controlled to a desired amount. Additionally, it should be understood that for eccentric loadings supports 48 may be located at appropriate position along the beam 14.

Figure 6:
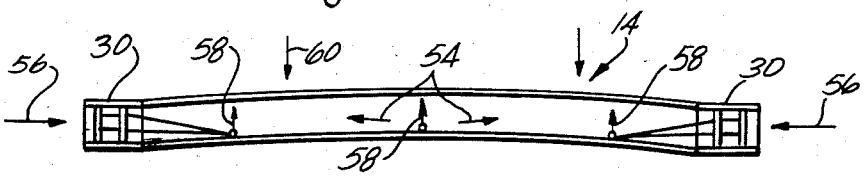
FIG. 6 is a schematic side view of the member according to the present invention showing the various forces acting thereon.

Turning to FIG. 6, the forces imposed upon the beam 14 of FIG. 2D are schematically illustrated. The tensioning of the tendons as shown by arrows 54 produces compression forces adjacent the ends of the beam 14 as shown by arrows 56. These compressive forces tend to counteract tensioning of the beam which may be caused by deflection under loading. The vertical resultant forces stemming from the tensioning of the tendons are represented at each support 48 by arrows 58. These vertical forces 58 tend to result in an upwardly bow in the member 14 as schematically illustrated in FIG. 6. When the beam 14 is loaded as represented by forces 60 such loads tend to deflect the beam 14 back to the horizontal or, depending upon the loads and the amount of tensioning of the tendons, to a sagged position. The deflection of the beam 14 under such loads increases the tension forces 54 of the tendons and thereby the vertical resultant forces 58 and compressive forces 56. These increases in the forces tend to counteract the effects of the loading forces 60 thereby enhancing the strength of the beam 14.

Figure 7:
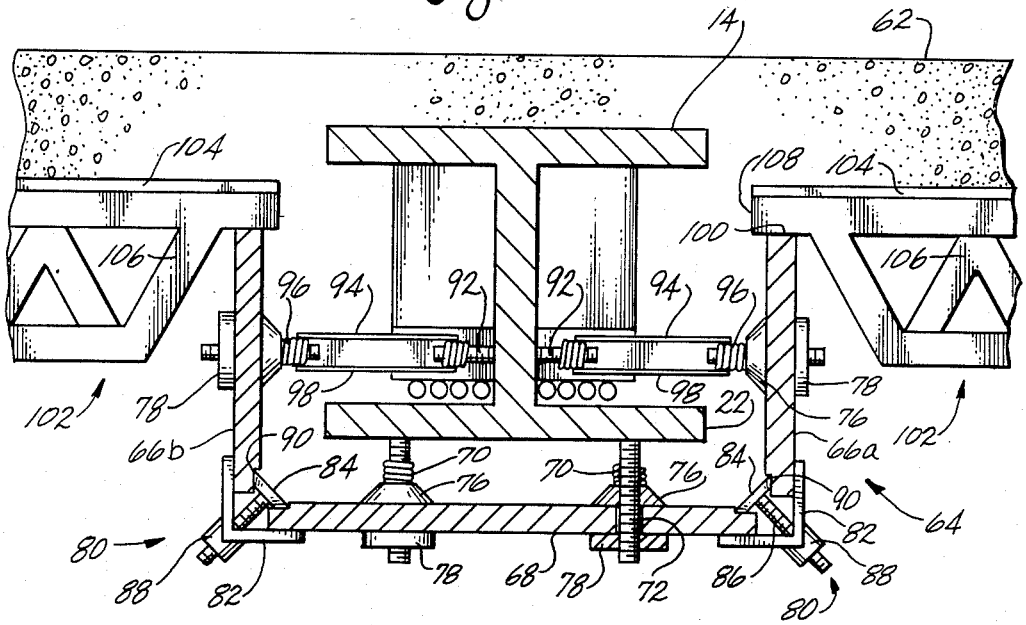
FIG. 7 is a section view of an element and the concrete forms supported thereby to recieve concrete.
Figure 8:
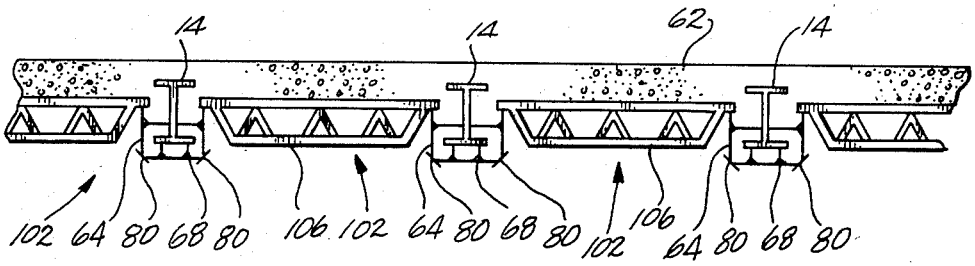
FIG. 8 is a schematic view showing a plurality of members and forms for forming a concrete floor.

To construct a concrete floor 62 for a structure incorporating the beams 14 forms and techniques as shown in FIGS. 7 and 8 are employed. After the beam 14 has been positioned and secured between the columns 12 for example as shown in FIG. 1, the aforementioned beam 14 provides support for forms useful in forming the concrete floor 62 and, if desired, encasing the beams 14 in concrete. Turning to specifically FIG. 7, a beam and the method including forms for forming the floor and encasing the beam are shown. Attached to the beam 14 and extending longitudinally there along is a form somewhat similar to the type described in my U.S. Pat. No. 3,857,540 issued Dec. 31, 1984, and more particularly, of the type similar to that described in my copending application Ser. No. 664,481 filed Sept. 5, 1984 and entitled "Column Form Support System and Method." Accordingly, the form 64 includes the side walls **66*a* and 66*b* and a bottom 68 which are coextensive with the beam 14. Secured to the beam flange 22 are form coupling means which may be embodied as threaded studs 70 welded to the beam in a manner known in the art. The studs 70 are positioned at intervals along the length of the beam 14**.

Threaded over each of the studs 70 are coils 74 to accommodate the threaded mounting of a cone 76 to each of the studs 70. The cones 76 are adapted to bear against the inside surface of the bottom 68. Threaded into each cone 76 through an opening 72 in the bottom 68, a retainer 78 adapted to bear against the bottom 68 and trap the bottom 68 against the cooperating cone 76. In this fashion, the bottom 68 is secured to the beam 14.

Each of the side walls 66 is coupled to the bottom 68 by angles 80. The angles 80 include an orthogonal backing 82 adapted to abut the outside surfaces of the bottom 68 and side walls 66 along the length thereof. The angle 80 further includes a wedge member 84 which is coupled to the backing 82 by a screw element 86. Upon rotation of the element 86 by, for example, a wing nut 88, the wedge member 84 is drawn toward the backing 82, trapping the bottom 68 and a selected one of its sides **66*a* or 66*b* against the backing 82. To accommodate the wedge member 84 each of the bottom and sides may be provided with a longitudinal extending groove 90. As can be appreciated, the angles 80 enable the form 64** to quickly and easily be assembled and subsequently disassembled.

To support each of the sides **66*a* and 66*b* against the hydraulic pressure of the concrete received by the form 64, externally threaded studs 92 are fastened to the beam web 20 at each side thereof and at spaced locations therealong. Threaded over each of the studs 92 is an extension 94 including at each end a coil 96. Rods 98 extend between the coils 96. Threadably received over each coil 96 remote from the web 20 is a cone 76 of the type described above. A retainer 78** passes through cooperative openings in the side wall and is likewise threadably received by the cone.

By adjusting the position of the cone 76 and by tightening the retainer 78 each side wall can appropriately be positioned and secured. It is to be understood that other means could be used to attach the form 64 to the beam 14.

Each of the side walls **66*a* and 66*b* terminates at an upper edge 100. The upper edges 100 of adjacent beams 14 provide support for spanner forms 102. The spanner forms 102 may be of any suitable design; however, as shown in the drawings, they may be embodied as having a planar upper surface 104 supported by a plurality of trusses 106. Each of the trusses 106 terminates at each end at a lip 108 which is adapted to rest upon the upper edge 100 for a side wall. By positioning the spanner forms 102, side by side along the length of the beam, an entire floor for a structure may be formed out. Further, by virtue of suspending the forms 64 from the beam 14, and the spanner forms 102 from the forms 64, an underlying network of scaffolding is not required to support the various forms. After the forms have been positioned, liquid concrete is poured over the spanner forms and more particularly the upper surface, the liquid concrete also filling the forms 64 and encasing the beams 14. Encasement of the beams 14 provide fire protection therefor. Absent encasement of the beams 14 a fire of some duration could affect the tendons 24** and affect the integrity of the pre-stressed construction element.

After the concrete has hardened, the retainers 78 are removed from the forms 64 freeing it from the beam 14. Further, the spanner forms 102 are likewise removed leaving behind a monolithic floor 62 and concrete encasement for the beam 14. After the forms have been removed, the cones 76 are unthreaded from the coils leaving behind conical cavities which may be filled in to present a pleasing appearance for the structure.

While I have shown and described certain embodiments of the present invention, it is to be understood that it is subject to many modifications of that departing from the spirit and scope of the invention set forth herein.

What is claimed is:

1. A pre-stressed construction element comprising:

a ridged member having a constant, I-shaped cross-section defined by a web spanning an upper and a lower flange, said member having a horizontal midplane disposed equidistant between said flanges;

a box disposed at each end of the member, each box having a pair of spaced plates extending between the flanges and projecting outwardly from the web;

a plurality of tensioned tendons disposed on each side of the web and connected between said boxes to place the member in compression, said tendons arranged in a spaced pattern at said plates at least one of said tendons disposed between the midplane and upper flange; and at least one support disposed intermediate of and at each side element, the support including a tube disposed to project outwardly from the web at a location near the lower flange and a strengthening strut interconnected between said tube and web, said tendons deflected by and imposing an upward force upon said support tube and strut and member.

2. The element of claim 1 including four tensioned tendons disposed at each side of the element, said tendons connected in a square pattern to said boxes with at least two tendons of each pattern disposed above the element midplane.

3. The element of claim 1 having one support disposed at each side of the member and midway between said boxes.

4. The element of claim 1 being no greater than three supports disposed at each side of the member, said supports equally spaced from one another and said boxes.

* * * * *